US009682257B2

(12) United States Patent
Zhao et al.

(10) Patent No.: US 9,682,257 B2
(45) Date of Patent: Jun. 20, 2017

(54) LIFE-SAVING SYSTEM FOR FIRE IN MULTI-STOREY BUILDING

(71) Applicant: ZHENGZHOU JINGCAN SECURITY ENGINEERING CO., LTD., Zhengzhou, Henan (CN)

(72) Inventors: Jingcan Zhao, Henan (CN); Jinxia Zhao, Beijing (CN); Mingpei Zhao, Henan (CN)

(73) Assignee: ZHENGZHOU JINGCAN SECURITY ENGINEERING CO., LTD., Zhengzhou, Henan (CN)

( * ) Notice: Subject to any disclaimer, the term of this patent is extended or adjusted under 35 U.S.C. 154(b) by 186 days.

(21) Appl. No.: 14/415,290

(22) PCT Filed: Jul. 12, 2013

(86) PCT No.: PCT/CN2013/079290
§ 371 (c)(1),
(2) Date: Jan. 16, 2015

(87) PCT Pub. No.: WO2014/012461
PCT Pub. Date: Jan. 23, 2014

(65) Prior Publication Data

US 2015/0174433 A1 Jun. 25, 2015

(30) Foreign Application Priority Data

Jul. 18, 2012 (CN) ..... 2012 2 0347222 U

(51) Int. Cl.
*F24F 7/06* (2006.01)
*F24F 7/007* (2006.01)
(Continued)

(52) U.S. Cl.
CPC ..... *A62B 11/00* (2013.01); *A62B 13/00* (2013.01); *F24F 7/08* (2013.01); *F24F 11/0086* (2013.01); *F24F 2011/0095* (2013.01)

(58) Field of Classification Search
CPC .. A62B 11/00; A62B 13/00; F24F 7/08; F24F 11/086
(Continued)

(56) References Cited

U.S. PATENT DOCUMENTS 4,245,779 A * 1/1981 Ardiente ..... F23N 3/06 126/285 B
5,829,210 A * 11/1998 Bernhardsson ..... E04B 5/48 454/233
(Continued)

FOREIGN PATENT DOCUMENTS

CN 201050856 Y 4/2008
CN 201276861 Y 7/2009
(Continued)

OTHER PUBLICATIONS

International Search Report issued in corresponding application No. PCT/CN2013/079290 on Sep. 19, 2013.

*Primary Examiner* — Helena Kosanovic
(74) *Attorney, Agent, or Firm* — Carter, DeLuca, Farrell & Schmidt, LLP

(57) ABSTRACT

The present disclosure relates to a life-saving apparatus and system for fire hazard in buildings. The life-saving system includes a main gas supply pipe and a main gas discharge pipe, the main gas supply pipe is provided with auxiliary gas supply pipes which includes a gas supply port located outside the main gas supply pipe and a gas inlet port located inside the main gas supply pipe, with the position of the gas supply port of the auxiliary gas supply pipe being higher than that of the gas inlet port; the main gas discharge pipe includes auxiliary gas discharge pipes which includes a gas
(Continued)

discharge port located outside the main gas discharge pipe and a gas outlet port located inside the main gas discharge pipe, with the position of the gas discharge port of the auxiliary gas discharge pipe being lower than that of the gas outlet port.

4 Claims, 1 Drawing Sheet

(51) Int. Cl.

| | |
|---|---|
| ***A62B 11/00*** | (2006.01) |
| ***F24F 7/08*** | (2006.01) |
| ***F24F 11/00*** | (2006.01) |
| ***A62B 13/00*** | (2006.01) |

(58) Field of Classification Search
USPC ..... 454/342
See application file for complete search history.

(56) References Cited

U.S. PATENT DOCUMENTS

| | | | | |
|---|---|---|---|---|
| 8,348,732 | B2 * | 1/2013 | Aronstam | F24F 3/00 236/49.1 |
| 9,086,226 | B2 * | 7/2015 | Bauer | F24F 11/0076 |
| 2010/0062704 | A1 * | 3/2010 | Markovich | F24F 13/06 454/284 |

FOREIGN PATENT DOCUMENTS

| | | | |
|---|---|---|---|
| CN | 101725242 | A | 6/2010 |
| CN | 102080457 | A | 6/2011 |
| CN | 202005965 | U | 10/2011 |
| CN | 202682593 | U | 1/2013 |

* cited by examiner

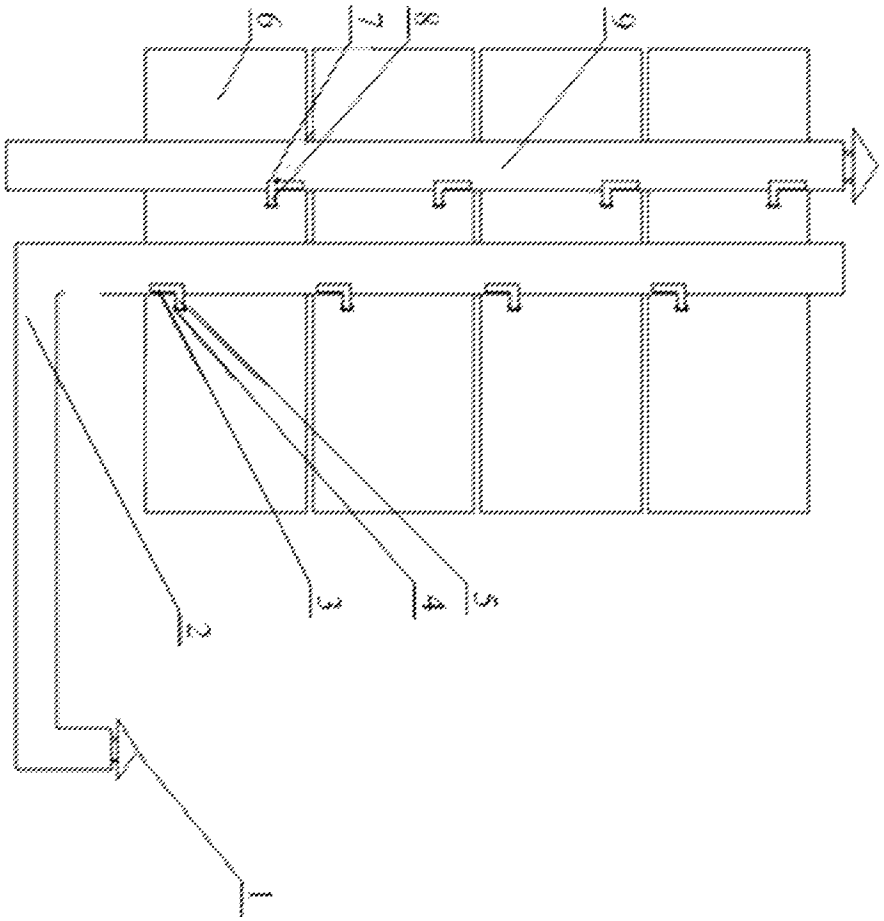
1
2
3
4
5
6
7
8
9

LIFE-SAVING SYSTEM FOR FIRE IN MULTI-STOREY BUILDING

TECHNICAL FIELD

The present invention relates to a life-saving apparatus, and particularly to a life-saving system for fire hazard in buildings.

BACKGROUND ART

Along with the development of national economy of China, more and more buildings are constructed in urban and rural, with the height larger and larger. Tall buildings have a great number of advantages, however fatal disadvantage apparent. For example, during a fire hazard in a tall building, it is very difficult for people to escape or being saved. However, the biggest cause for injuries and deaths in a fire hazard is suffocation induced from fume, instead of fire burn.

DISCLOSURE OF THE INVENTION

An object of the present invention is to provide a life-saving system for fire hazard in buildings which can highly effectively reduce the number of the injuries and deaths during a fire hazard due to suffocation induced from fume.

In order to achieve the above object, the present invention uses the following technical solution: a life-saving system for fire hazard in buildings comprising a main gas supply pipe and a main gas discharge pipe, wherein the main gas supply pipe is provided with auxiliary gas supply pipes each of which comprises a gas supply port located outside the main gas supply pipe and a gas inlet port located inside the main gas supply pipe, with the position of the gas supply port of the auxiliary gas supply pipe being higher than that of the gas inlet port; the main gas discharge pipe is provided with auxiliary gas discharge pipes each of which comprises a gas discharge port located outside the main gas discharge pipe and a gas outlet port located inside the main gas discharge pipe, with the position of the gas discharge port of the auxiliary gas discharge pipe being lower than that of the gas outlet port.

Preferably, the number of the auxiliary gas supply pipes is the same as that of the auxiliary gas discharge pipes, and the positions of the former are corresponding to the positions of the later.

Preferably, the present invention also comprises isolation chambers with sealing doors provided thereon, wherein the gas supply port of the auxiliary gas supply pipe and the gas discharge port of the auxiliary gas discharge pipe are provided in the isolation chamber.

Preferably, a gas supply opening of the main gas supply pipe is provided with a protecting cover, and a gas discharge opening of the main gas discharge pipe is provided with a protecting cover as well. The life-saving system for fire hazard adopting the above technical solution is arranged within toilets, washrooms, or storage rooms in a tall building where people live, work and have activities.

When a fire hazard occurs, people should enter quickly the room where the life-saving system is arranged, and close the door and the window and open the gas supply port of the auxiliary gas supply pipe and the gas discharge port of the auxiliary gas discharge pipe. Thanks to the sealing door and window of the toilet blocking the fume and fire, the auxiliary gas supply pipe supplying fresh air, and the auxiliary gas discharge pipe discharging polluted air, the lives of people within the toilet are assured safe, and it is prevented that the people is suffocated due to inhaling poisonous fume.

BRIEF DESCRIPTION OF DRAWINGS

FIG. 1 is a structural schematic view of the present invention.

DETAILED DESCRIPTION OF EMBODIMENTS

Below, the present invention is further described in detail by means of embodiments, in conjunction with figures.

As shown in FIG. 1, a life-saving system for fire hazard in buildings comprises a main gas supply pipe 2 and a main gas discharge pipe 9, wherein the main gas supply pipe 2 is provided with auxiliary gas supply pipes 3, a gas supply port 5 of the auxiliary gas supply pipe 3 is located outside the main gas supply pipe 2, and a gas inlet port of the auxiliary gas supply pipe 3 is located inside the main gas supply pipe 2, with the position of the gas supply port 5 of the auxiliary gas supply pipe 3 being higher than that of the gas inlet port of the auxiliary gas supply pipe; the main gas discharge pipe 9 is provided with auxiliary gas discharge pipes 7, a gas discharge port 8 of the auxiliary gas discharge pipe 7 is located outside the main gas discharge pipe 9, and a gas outlet port of the auxiliary gas discharge pipe 7 is located inside the main gas discharge pipe 9, with the position of the gas discharge port 8 of the auxiliary gas discharge pipe being lower than that of the gas outlet port of the auxiliary gas discharge pipe. A gas supply opening of the main gas supply pipe 2 is provided with a protecting cover 1, and a gas discharge opening of the main gas discharge pipe 9 is provided with a protecting cover as well. The top end of the main gas supply pipe and the lowest end of the main gas discharge pipe are sealed.

The auxiliary gas supply pipes and the auxiliary gas discharge pipes are corresponding to each other in terms of number and positions. The function of the auxiliary gas supply pipes and the auxiliary gas discharge pipes is to block air exchange between toilets on the upper and lower floors.

It also comprises isolation chambers 6 with sealing doors and windows provided thereon. The main gas supply pipe 2 and the main gas discharge pipe 9 pass through the inside of the isolation chambers, and each isolation chamber is provided therein with one auxiliary gas supply pipe 3 and one auxiliary gas discharge pipe 7. The gas supply port 5 of the auxiliary gas supply pipe is equipped with a sealing cover 4, and the gas discharge port 8 of the auxiliary gas discharge pipe is equipped with a sealing cover as well.

The apertures of the main gas supply pipe and the main gas discharge pipe may be selected properly based on the height of the building. The main gas supply pipe, the auxiliary gas supply pipe, the main gas discharge pipe and the auxiliary gas discharge pipe are all made of various nontoxic and tasteless materials, such as plastics, metal, glass steel, fiber, wood, bamboo and so on.

During the usage of the present invention, preferably the toilet, washroom or storage room in the building is used as the isolation chamber. The doors and windows are sealed and treated with fire resistive material. The gas inlet opening of the main gas supply pipe starts from air freshening lawn, parterre and grove around the building or from locations far away from the fire, such as gable wall or basement of the building. The gas supply port of the auxiliary gas supply pipe is located in the toilet. The air discharge opening of the main air discharge pipe is located at the gable wall on the top of the building or at the top of the building, and the gas discharge port of the auxiliary gas discharge pipe is located in the toilet.

According to the property that the air rises when heated and falls when cooled, when hot air in the toilet flows to the outside of the gas discharge opening of the main gas discharge pipe through the gas discharge port of the auxiliary gas discharge pipe, it is inevitable that cool air enters the gas supply opening of the main gas supply pipe and flow in and fill in blank space of air within the toilet through the gas supply port of the auxiliary gas supply pipe. Therefore, air exchange in the toilet is continuously supported by the gas supply pipe and the gas discharge pipe, assuring oxygen balance in the toilet and meeting normal oxygen requirement by people therein.

When a fire hazard occurs, people enter quickly a toilet, and close the door and the window and open the gas supply port of the auxiliary gas supply pipe and the gas discharge port of the auxiliary gas discharge pipe. Thanks to the door and the window of the toilet blocking the fume and fire, the auxiliary gas supply pipe supplying fresh air, and the auxiliary gas discharge pipe discharging polluted air, the lives of people within the toilet are assured safe.

The present invention does not consume energy and not need maintenance and is of pollution free and noiseless, without affecting normal usage and inherent functions of a toilet. The technical life span reaches up to 50 to 80 years. It can be effective during the whole life of a building and closely linked with house-owner.

The above is only preferable embodiment of the present invention, and not intended to limit the same. As for one skilled in the art, various changes and variations may be made to the present invention. Any modifications, equivalents and improvements, without departing from the spirit and principle of the present invention, should be covered in the protection scope of the present invention.

The invention claimed is:

1. A life-saving system for a fire hazard, comprising:

a main gas supply pipe configured to be vertically positioned in a building; and a main gas discharge pipe configured to be vertically positioned in the building, wherein the main gas supply pipe includes auxiliary gas supply pipes each of which comprises a gas supply port located outside the main gas supply pipe and a gas inlet port located inside the main gas supply pipe, with a position of the gas supply port of the auxiliary gas supply pipe being higher than a position of the gas inlet port, wherein the main gas discharge pipe includes auxiliary gas discharge pipes each of which comprises a gas discharge port located outside the main gas discharge pipe and a gas outlet port located inside the main gas discharge pipe, with a position of the gas discharge port of the auxiliary gas discharge pipe being lower than a position of the gas outlet port, wherein the auxiliary gas supply pipes and the auxiliary gas discharge pipes are in an L shape, wherein each of the auxiliary gas supply pipes in the L shape has a horizontal side inserted into a side wall of the main gas supply pipe and a vertical side configured to be vertically positioned and have an end facing downwards, an end of the horizontal side of the auxiliary gas supply pipe is embodied as the gas supply port, and the end of the vertical side of the auxiliary gas supply pipe is embodied as the gas inlet port, and wherein each of the auxiliary gas discharge pipes in the L shape has a horizontal side inserted into a side wall of the main gas discharge pipe and a vertical side configured to be vertically positioned and have an end facing upwards, an end of the horizontal side of the auxiliary gas discharge pipe is embodied as the gas discharge port, and the end of the vertical side of the auxiliary gas discharge pipe is embodied as the gas outlet port.

2. The life-saving system for a fire hazard according to claim 1, wherein a number of the auxiliary gas supply pipes is the same as a number of the auxiliary gas discharge pipes, and wherein positions of the auxiliary gas supply pipes are corresponding to positions of the auxiliary gas discharge pipes.

3. The life-saving system for a fire hazard according to claim 1, further comprising isolation chambers, each of the isolation chambers including a sealing door, wherein the gas supply port of the auxiliary gas supply pipe and the gas discharge port of the auxiliary gas discharge pipe are provided in the isolation chamber.

4. The life-saving system for a fire hazard according to claim 1, wherein a gas supply opening of the main gas supply pipe is provided with a protecting cover, and a gas discharge opening of the main gas discharge pipe is provided with a protecting cover.

* * * * *